United States Patent [19]

Hirooka et al.

[11] Patent Number: 5,074,760

[45] Date of Patent: Dec. 24, 1991

[54] SCROLL TYPE COMPRESSOR

[75] Inventors: Katsumi Hirooka; Takahisa Hirano; Tetsuo Ono; Ryuhei Tanigaki, all of Aichi, Japan

[73] Assignee: Mitsubishi Jukogyo Kabushiki Kaisha, Tokyo, Japan

[21] Appl. No.: 382,482

[22] Filed: Jul. 19, 1989

[30] Foreign Application Priority Data

Aug. 12, 1988 [JP] Japan ..... 63-199998

[51] Int. Cl.[5] ..... F04B 49/00; F04B 23/00; F03C 2/00

[52] U.S. Cl. ..... 417/310; 417/304; 417/440; 418/55.1

[58] Field of Search ..... 418/55 R; 417/304, 440, 417/310

[56] References Cited

U.S. PATENT DOCUMENTS

| | | | |
|---|---|---|---|
| 3,224,662 | 12/1965 | Oldberg . | |
| 4,389,171 | 6/1983 | Eber et al. | 418/55 R |
| 4,497,615 | 2/1985 | Griffith | 417/440 |
| 4,514,150 | 4/1985 | Hirage et al. . | |
| 4,642,034 | 2/1987 | Terauchi | 417/310 |
| 4,818,195 | 4/1989 | Murayama et al. | 418/55 R |

FOREIGN PATENT DOCUMENTS

| | | | |
|---|---|---|---|
| 480617 | 8/1916 | France . | |
| 54-28002 | 3/1979 | Japan . | |
| 0119080 | 7/1984 | Japan | 418/55 R |
| 0001397 | 1/1985 | Japan | 417/440 |
| 6238886 | 2/1985 | Japan . | |
| 61-15275 | 4/1986 | Japan . | |

*Primary Examiner*—Richard A. Bertsch
*Assistant Examiner*—Alfred Basichas
*Attorney, Agent, or Firm*—McAulay Fisher Nissen Goldberg & Kiel

[57] ABSTRACT

A rotary compressor is disclosed which is equipped with a bypass hole for bypassing a fluid under compression to the intake side and the capacity thereof is controlled through opening and closing of the bypass hole with a piston which is operated via a control valve, whereby the bypass hole is opened at or in the vicinity of a discharge port of the compressor and the capacity of the compressor is made to be controllable in the range of one hundred to substantially zero percent. By the application of such a rotary compressor to the compressor for an air conditioner, capacity control in the range of about zero to 100% of discharge quantity can be accomplished so that it becomes possible to obtain cooling capability which is in response to the heat load.

5 Claims, 17 Drawing Sheets

SCROLL TYPE COMPRESSOR

FIELD OF THE INVENTION AND RELATED ART STATEMENT

The present invention relates to a rotary compressor of such type as rotary vane, sliding vane, screw, scroll or the like.

As an example of the prior art there is shown a hermetically sealed motor driven rotary compressor in FIG. 10 and FIG. 11. FIG. 10 is a vertical sectional diagram and FIG. 11 is a vertical sectional diagram as seen along the line XI—XI in FIG. 10. In FIG. 10 and FIG. 11, 10 is a housing which houses a power element A consisting of a motor rotor 09, a motor stator 08 and the like, and a compression element B consisting of a crankshaft 01, a roller 02, an upper bearing 03, a lower bearing 04, a cylinder 05, a blade 06 (FIG. 11), a spring 07 (FIG. 11) and the like. The crankshaft 01 is rotated by the motor stator 08 and the motor rotor 09 to cause an eccentric motion in the roller 02, and sucks and compresses a gas by changing the volume of a compression space 05*a*. Sucked gas is brought into the compression space 05*a* through an accumulator 11, an inlet pipe 12 and an inlet space 31, changed to a high pressure gas by the compression action, and discharged to the outside of the housing 10 from a discharge pipe 18 through a discharge port 30, a discharge valve 15, a discharge valve hole 21, a discharge opening 22, and through a discharge muffler 20 and a discharge gas passage 17. On the other hand, lubrication oil is filled in the housing 10 to the neighborhood of the normal oil surface 19, rises within an oil pump 14 through a lubrication oil intake port 13, and lubricates the roller 02, the upper bearing 03, the lower bearing 04 and the like. The blade 06 is immersed in the lubrication oil and carries out a reciprocating motion following the eccentric motion of the roller 02 so that it can be lubricated thoroughly. When such a compressor is used as a compressor for air conditioner, as the blow-off temperature goes down with increase in the cooling capability, a frost prevention thermoswitch of the evaporator is actuated, and the compressor repeats turning on and off. As a result, there have been problems such as lowering of the cool feeling due to variation in the blow-off temperature, increase of power due to rise in the torque at the time of starting, and generation of vibrations due to shocks at the time of starting and stopping of the compressor.

With the above in mind, there is proposed the following compressor. Namely, as shown in FIG. 12, a cylinder 32 is provided within the lower bearing 04, and the cylinder 32 is communicated via a bypass hole 33 to a portion of the compression space 05*a*, and also communicated via the bypass passage 34 to the inlet space 31. Further, the bypass hole 33 and the bypass passage 34 are made communicable and interruptable by means of a piston 35 slidably fitted within the cylinder 32, and a compression spring 36 is interposed behind the piston 35 and the low pressure on the inlet side is introduced via a circuit 37 and an electromagnetic valve 38 so as to control the capacity of the compressor.

With this arrangement, when the thermal load is large, the compressor can be operated at full output power by blocking the bypass hole 33 with the piston 35. Further, when the thermal load is reduced, the electromagnetic valve 38 is opened to move the piston 35 to the left of the figure, the refrigerant gas under compression is bypassed to the inlet space 31 side by communicating the bypass hole 33 and the bypass passage 34, and the number of times of turning on and off of the compressor is reduced by arranging the compressor output to match the load. With the use of a conventional compressor without capacity control mechanism, when the cooling capability becomes too large for the thermal load, the compressor is operated intermittently by the frost preventing thermoswitch of the evaporator, resulting in a problem of causing a drop of cooling feeling.

Further, in a compressor with capacity control mechanism, the aforementioned problems can be improved to a large extent compared with the case of a compressor without capacity control. Yet, the following problems are generated in such a compressor. Namely, when the air conditioner is used throughout the four seasons, during the periods where the cooling capability is relatively unnecessary such as during the between season and the winter period, the output of the compressor becomes relatively large with cooling capability which is too large. This causes an intermittent operation of the compressor which sometimes results in the lowering of air-conditioning feeling. Further, when the compressor is operated at a high rotational frequency, similar phenomenon also takes place occasionally. In other words, with the conventional compressor there has been a problem that the range of capacity control is not sufficiently wide.

OBJECT AND SUMMARY OF THE INVENTION

The present invention was accomplished with the above in mind, and it is, therefore, the object of the invention to provide a rotary compressor which can resolve the above-mentioned problems, carrying out a continuous operation, and generating a suitable output in response to the load.

In order to achieve the above object, in a rotary compressor provided with a bypass hole which causes a fluid under compression to be bypassed to the inlet side, and controls its capacity by opening and closing the bypass hole with a piston that is operated via a control valve, the present invention has a constitution as characterized in (1) and (2) below.

(1) The bypass hole is opened at a position of the revolving angle for which the compressed volume is in the range of zero to several percents of the volume of the compression space in the diagram representing the dependence of the compressed volume on the revolving angle, and the capacity of the compressor is made to be controllable in the range of 100 to substantially zero percent.

(2) A plurality of the bypass holes are provided along the direction of rotation, and at least one of them is opened at the position of the revolving angle for which the compressed volume is in the range of zero to several percents of the volume of the compression space in the diagram showing the dependence of the compressed volume on the revolving angle, and the capacity of the compressor is made to be controllable in the range of 100 to substantially zero percent.

The action of the present invention is as will be described below.

The bypass hole is provided at the position for which the flow rate of bypassing of a gas under compression from the compression space to the inlet space is appropriate in the compressed volume-revolving angle relation. Then, the opening and closing of the hole is controlled by the action of a piston operated via a control valve, and the capacity control is executed in the range of 0 to 100% or several to 100% of the actual discharge quantity of the compressor.

From what is described in the above, the present invention can achieve the following effect.

From the above, through capacity control of the compressor it is possible to obtain a suitable output in response to the load. Further, when this compressor is used in the air conditioner, it is possible to obtain a cooling capacity in response to the thermal load. Therefore, there is no action of a frost thermoswitch of the unit, so that a continuous operation of the compressor becomes possible and an enhancement of cooling feeling and a reduction of power consumption can be achieved.

DETAILED DESCRIPTION OF PREFERRED EMBODIMENTS

FIG. 1 to FIG. 9 show embodiments (the first to the third embodiments) of the present invention as applied to the sealed motor driven type rotary compressor.

First Embodiment

Figure 1:
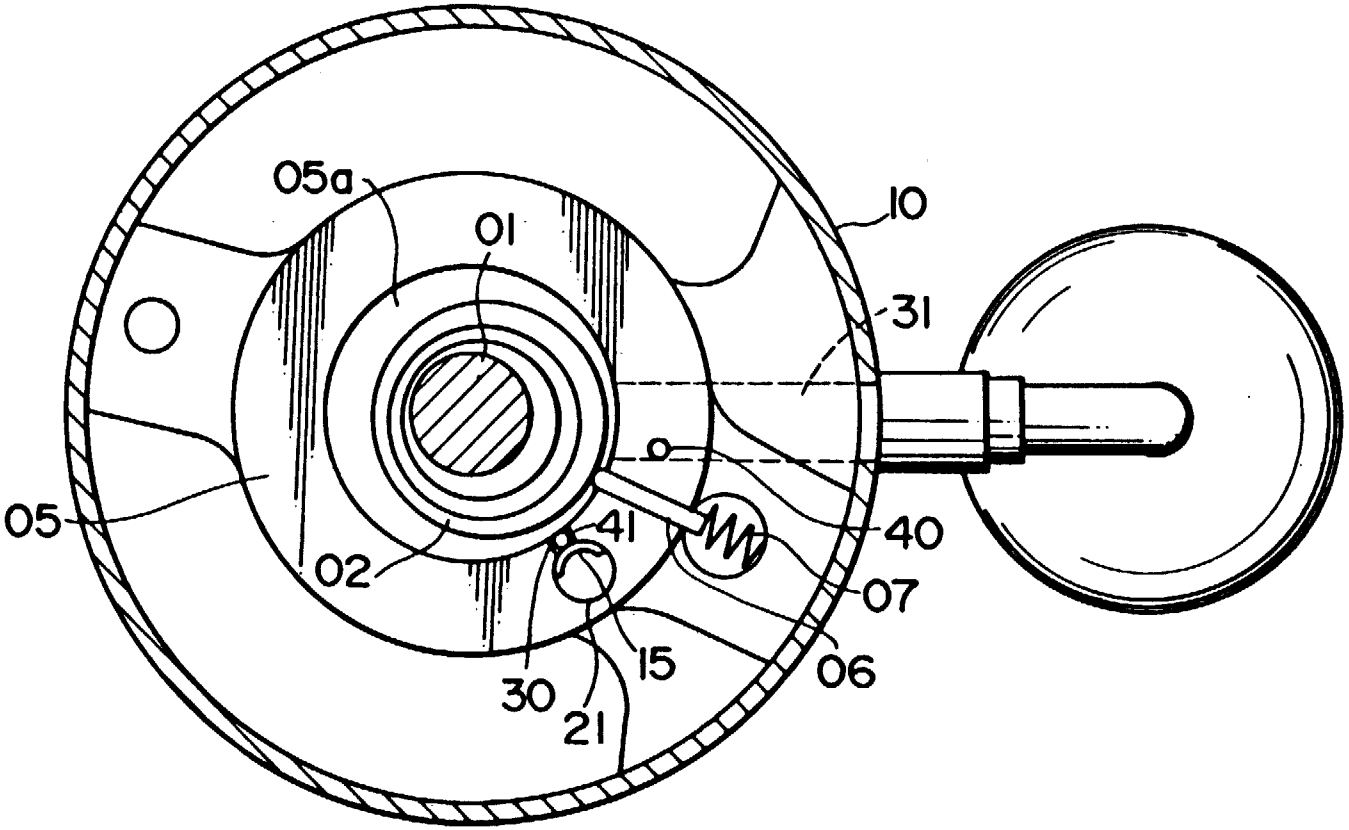
FIG. 1 is a sectional view of the rotary compressor which is a first embodiment of the present invention, a diagram corresponding to FIG. 11 of the prior art.
Figure 2:
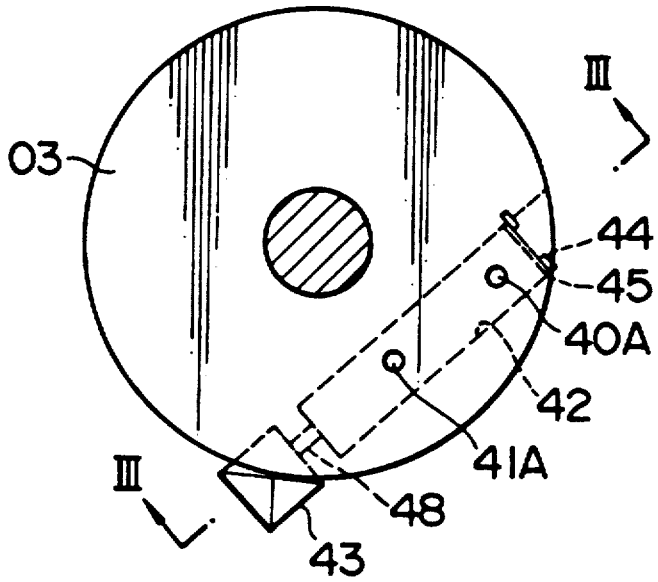
FIG. 2 is a sectional diagram corresponding to the view along the line II—II in FIG. 10 of the prior art.
Figure 3:
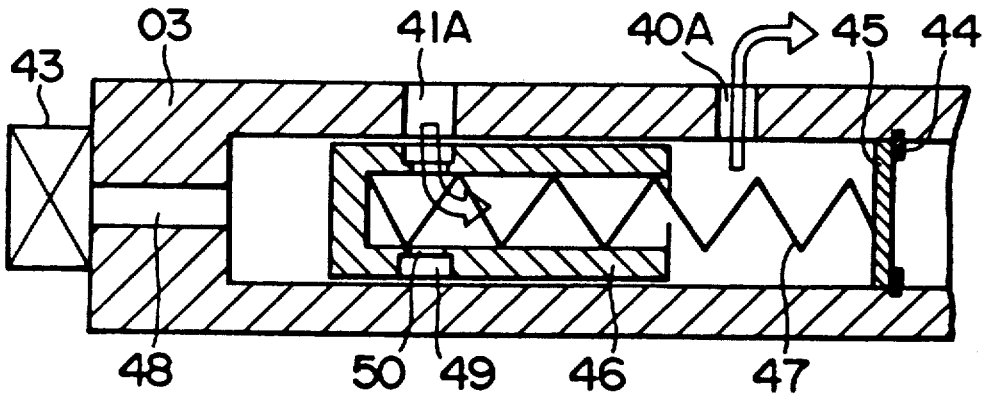
FIG. 3 is a sectional diagram along the line III—III in FIG. 2.
Figure 10:
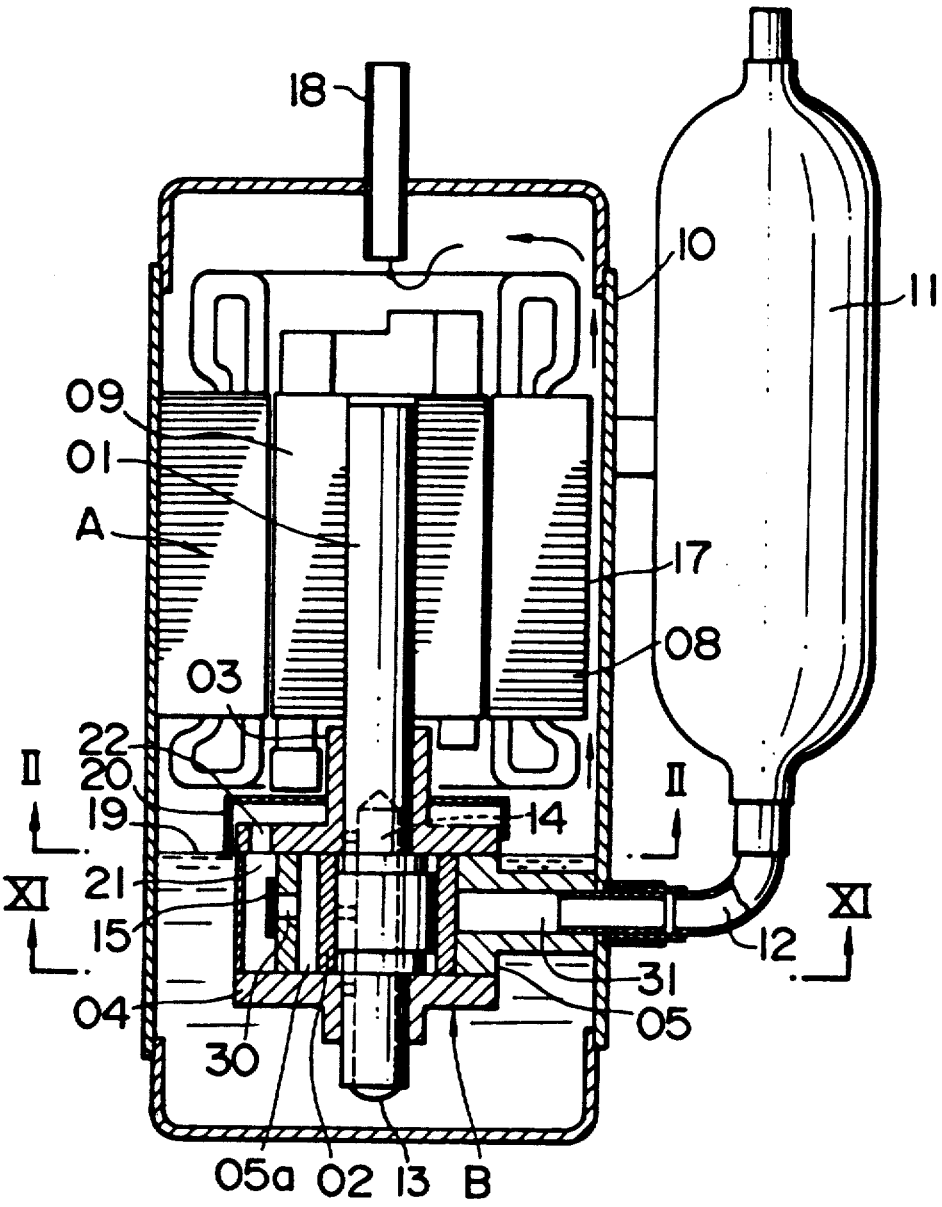
FIG. 10 (PRIOR ART)
FIG. 10 is a vertical sectional view of the prior art rotary compressor.
Figure 11:
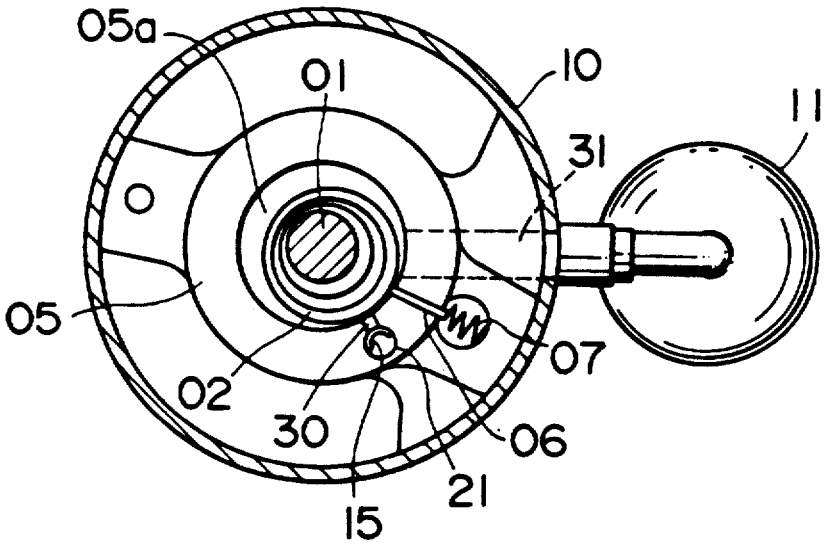
FIG. 11 (PRIOR ART)
FIG. 11 is a sectional diagram as seen along the line XI—XI in FIG. 10.
Figure 12:
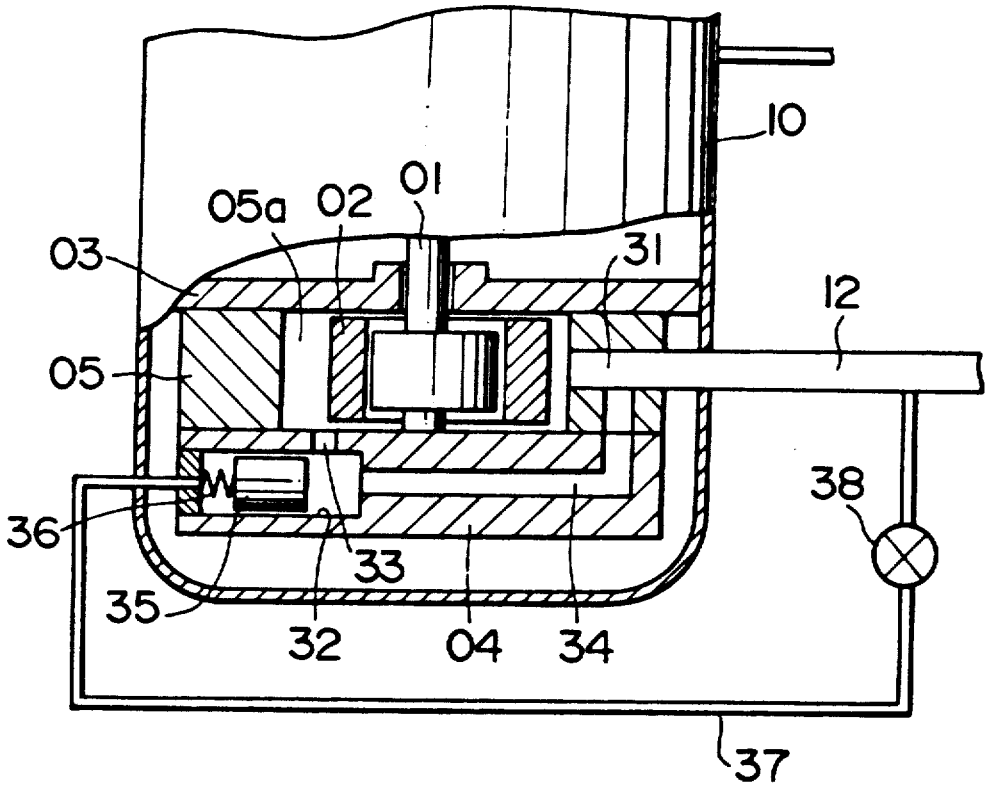
FIG. 12 (PRIOR ART)
FIG. 12 is a sectional view of the prior art rotary compressor equipped with a capacity control mechanism.

FIG. 1 is a sectional diagram of the first embodiment in the rotary compressor of the present invention which corresponds to FIG. 11 of the prior art compressor, FIG. 2 is a sectional diagram corresponding to the sectional diagram as seen along the line II—II in FIG. 10 of the prior art compressor, and FIG. 3 is a sectional diagram viewed along the line III—III in FIG. 2. In the drawings, 40 is a hole provided in cylinder 05, and is communicated to an inlet space 31. Reference numeral 41 is a hole provided in the cylinder 05, and is communicated with a discharge port 30 in front of a discharge valve 15. In an upper bearing 03 there is provided a device consisting of an unloader piston hole 42, a control passage 48, a pressure control valve 43, a stiffening plate 45, a fixing ring 44, a piston 46 and a spring 47. Reference numeral 40A is a bypass cylinder communicated with the unloader piston hole 42, and is communicated with an input space via the cylinder hole 40. Reference numeral 41A is a bypass hole penetrating to the unloader piston hole 42, and is communicated with the discharge port 30 via the cylinder hole 41. Namely, a bypass passage is formed from the discharge port 30 to the inlet space 31 via the unloader piston hole 42.

Reference numeral 43 is the pressure control valve, and the controlled pressure is applied to the piston 46 via the passage 48 to move the piston 46, and the bypass holes 40A and 41A are opened and closed. Reference numeral 49 is a circumferential groove provided in the piston 46, and 50 is a hole provided for communication with the unloader piston hole 42 (several of them may be formed depending upon the quantity for bypassing). Reference numeral 45 is a stiffening plate serving for both as stopper and seal for the piston 46 and the spring 47, and 44 is a fixing ring for fixing the stiffening plate 45 (installation of an O ring is desirable for the seal).

In the present embodiment, by constructing such a bypass passage, capacity control is executed by bypassing the compressed gas in front of the discharge valve to the inlet space through the bypass passage, in response to the required cooling capability. The quantity of capacity is controlled by adjusting the opening of the bypass hole by means of the unloader piston that is operated by the capacity control valve. As a result, the capacity of discharge quantity of the compressor becomes controllable in the range of 100 to 0%, and hence it becomes possible to enhance the cooling feeling through continuous operation of the compressor without requiring turning on and off of the compressor. FIG. 3 shows the condition in which the bypass passage which connects the front of the discharge valve to the inlet space is fully opened and the output is close to 0%.

Second Embodiment

Figure 4:
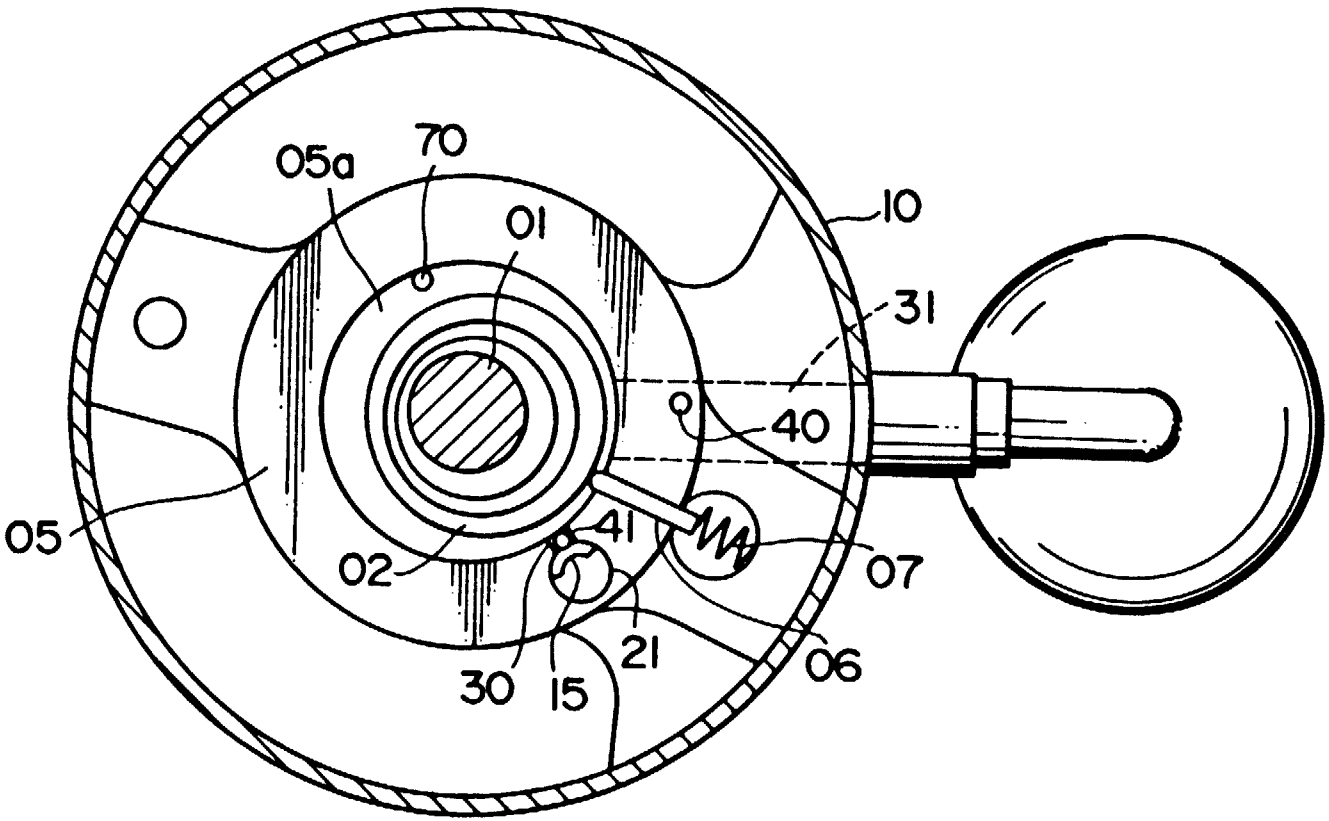
FIG. 4 is a sectional view of the rotary compressor which is a second embodiment of the present invention.
Figure 5:
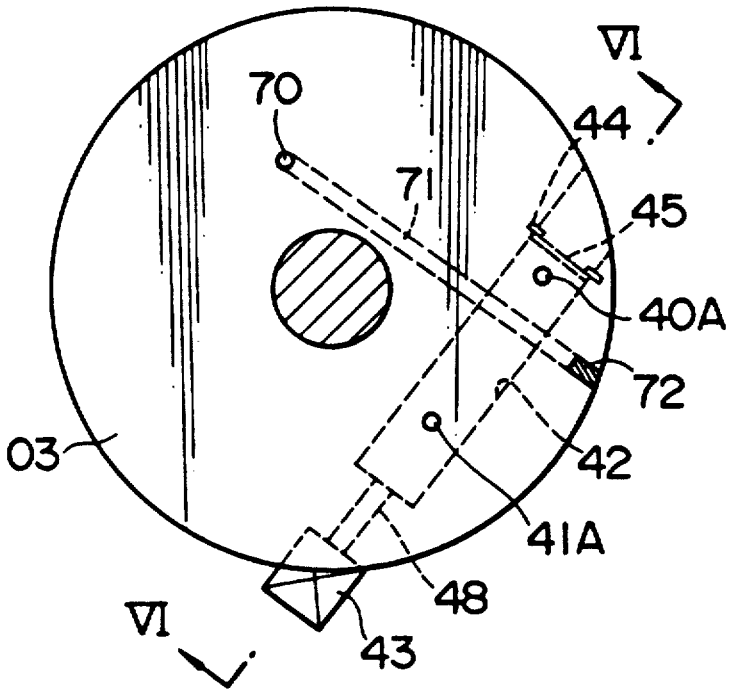
FIG. 5 is a sectional view corresponding to FIG. 2.
Figure 6:
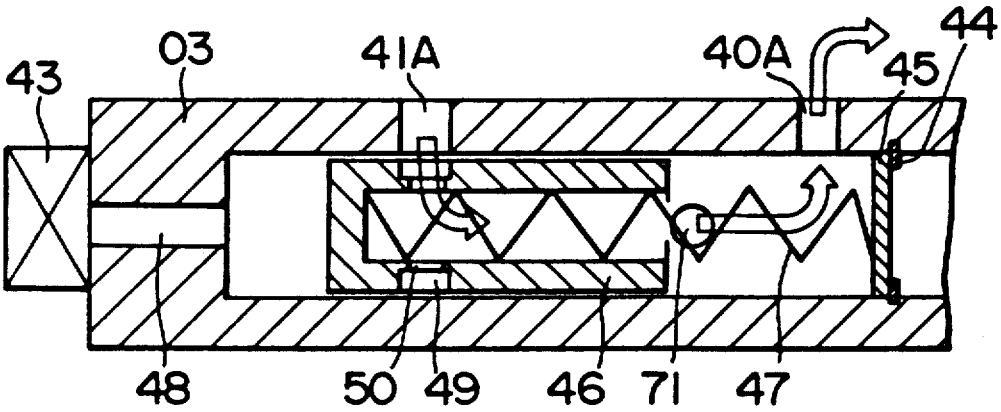
FIG. 6 is a sectional view corresponding to FIG. 3.

FIG. 4 is a sectional diagram of the rotary compressor in accordance with the second embodiment of the present invention, a diagram corresponding to FIG. 1, FIG. 5 is a sectional diagram corresponding to FIG. 2, and FIG. 6 is a sectional diagram corresponding to FIG. 3. In the drawings, 70 is a bypass hole at the position of volume of about 50%, which is provided in the upper bearing 03. Namely, the bypass hole 70 is provided at the position of revolving angle of the roller for which the compressed volume, in the relationship of the roller revolving angle relative to the compressed volume of the compressor (referred to simply as volume-revolving angle relation hereinafter), is 50%. Further, a bypass hole passage 71 is provided so as to communicate the bypass hole 70 with the unloader piston hole 42. Reference numeral 72 is a sealing plug. The construction other than the above is similar to the first embodiment.

In the first embodiment, at the time of capacity control, only the compressed gas in front of the discharge valve is bypassed to the inlet space, so that output control was occasionally insufficient depending on the manner in which the bypass hole is provided. The aim of the present embodiment is to assure the action of the first embodiment. In the present embodiment, the bypass passage is constructed as shown in FIGS. 4 and 5 so that at the start of capacity control the compressed gas is first bypassed to the inlet space by the opening of the hole at the position of volume of about 50% caused by the motion of the piston. As the piston moves further, the bypass passage in front of the discharge valve is opened to the inlet space, increasing further the rate of capacity control. As a result, better volume control rate can be assured compared with the case of the first embodiment, and an enhancement of cooling feeling can be obtained. FIG. 6 shows the condition in which the output is close to 0% as a result of full opening by the piston of the bypass passage 41A in front of the discharge valve and the hole 70 at the position of volume of about 50%.

Third Embodiment

Figure 7:
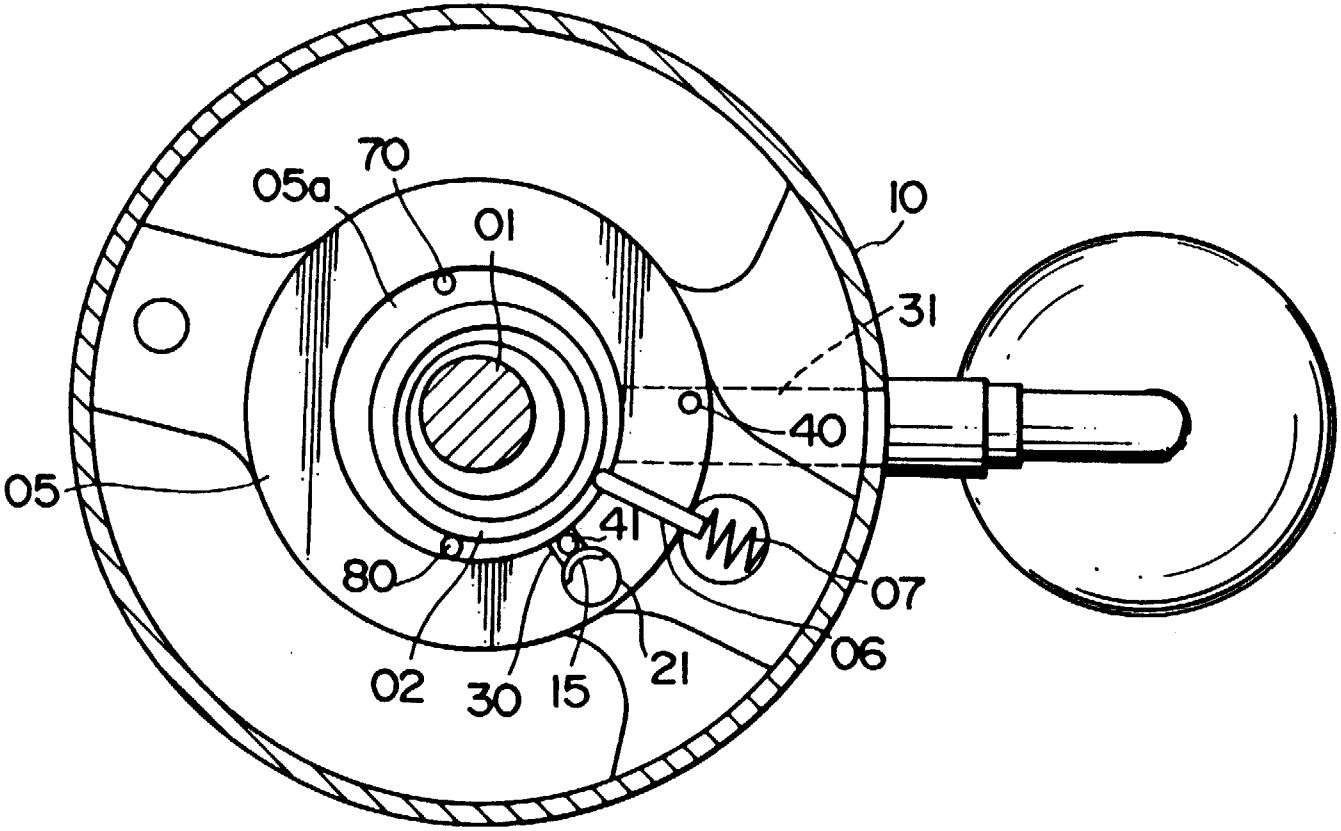
FIG. 7 is a sectional view of a third embodiment of the rotary compressor in accordance with the present invention, a diagram corresponding to FIG. 1 or FIG. 4.
Figure 8:
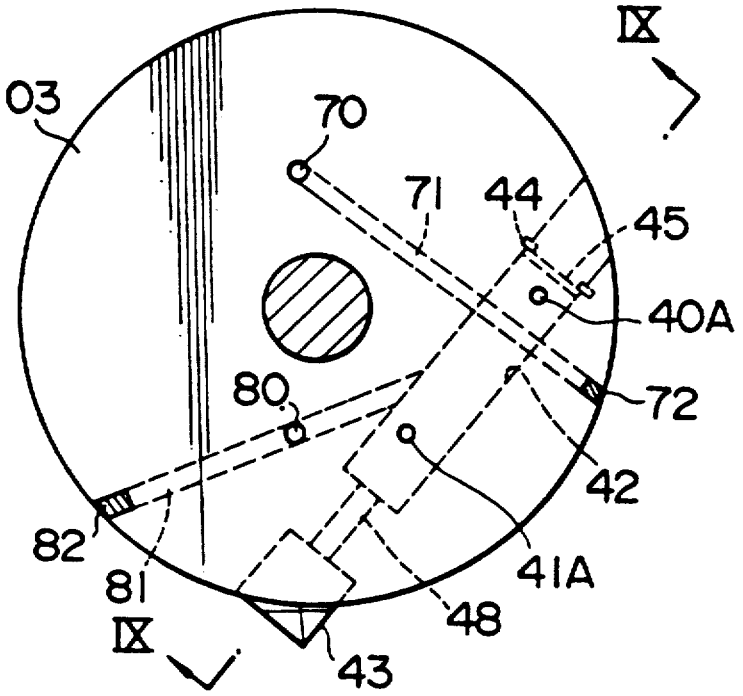
FIG. 8 is a sectional diagram corresponding to FIG. 2 or FIG. 5.
Figure 9:
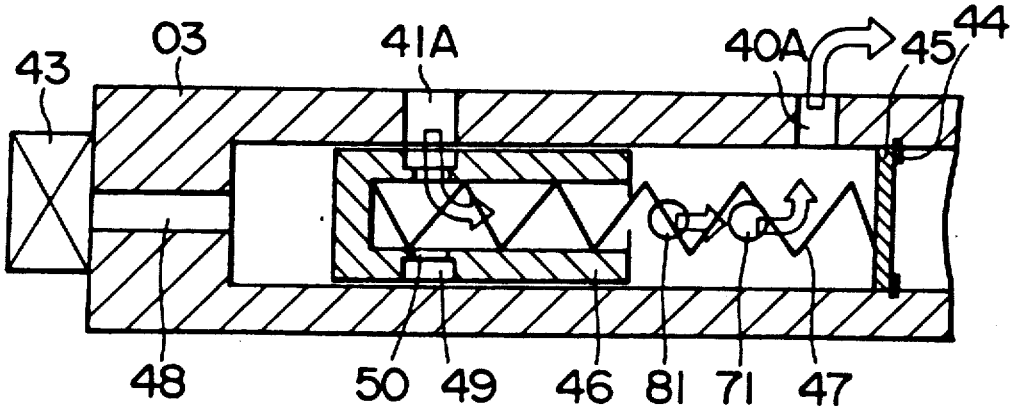
FIG. 9 is a sectional diagram corresponding to FIG. 3 or FIG. 6.

FIG. 7 is a sectional diagram of the rotary compressor in accordance with the third embodiment of the present invention, a diagram corresponding to FIG. 1 or FIG. 4, FIG. 8 is a sectional diagram corresponding to FIG. 2 or FIG. 5, and FIG. 9 is a sectional diagram corresponding to FIG. 3 or FIG. 6. Reference numeral 80 is a bypass hole at the position of volume of about 30%, provided in the upper bearing 03. Further, a bypass hole passage 81 is provided so as to communicate the bypass hole 80 with the unloader piston hole 42. Reference numeral 82 is a sealing plug. The construction other than the above is similar to the second embodiment.

In the second embodiment, at the time of capacity control, only the compressed gas in front of the discharge valve and at the position of capacity of about 50% is bypassed to the inlet space, so that the capacity control was sometimes insufficient depending on the manner in which these bypass passages are provided. The present embodiment is to assure the action of the second embodiment described above. By constructing the bypass passage as shown in FIGS. 7 and 8, at the start of capacity control, the hole at the position of volume of about 50% is first opened to be bypassed by the piston to the inlet space. As the piston moves further, the hole at the position of volume of about 30% is opened to be bypassed to the inlet space. As the piston moves still further, the bypass passage in front of the discharge valve is opened to the inlet space, and the rate of output control is further enhanced. As a result, capacity control can be carried out more securely compared with the case of the second embodiment, enhancing the cooling feeling. In FIG. 9, there is shown the condition of output of close to 0% in which the hole at the position of volume of about 50%, the hole at the position of volume of about 30% and the bypass passage in front of the discharge valve are fully opened by the piston.

In the above embodiments, cases are shown in which bypass holes are provided in the discharge port between the discharge valve and the compression space. However, when the output is controlled down to about several percents, there is no substantially large difference from the case of control at 0%. Because of this, it is possible to provide a bypass hole at the position of volume of several percents in the diagram showing the volume-revolving angle relation of the compressor, instead of the so-called 0% bypass holes opened to the discharge port shown in the above embodiments.

Fourth Embodiment

Next, an embodiment of the present invention as applied to the scroll compressor will be described.

Figure 13:
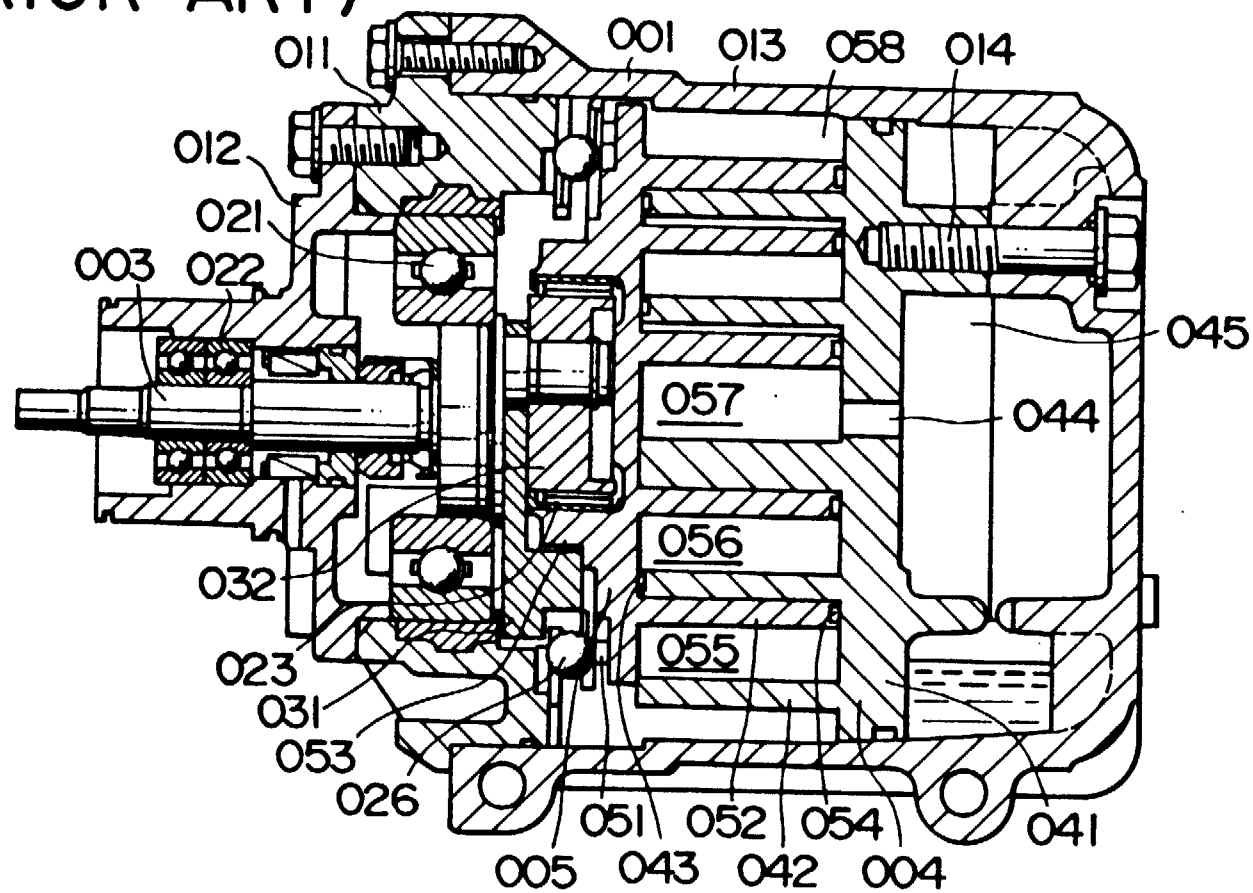
FIG. 13 (PRIOR ART)
FIG. 13 is a vertical sectional diagram showing a known scroll compressor.

First, referring to FIG. 13, the basic construction of the scroll compressor will be described. FIG. 13 is a vertical sectional diagram of the scroll compressor in which the compressor main body 001 consists of a front case 011, a front nose 012 and a housing 013. A main bearing 021 is provided at about the center of the front case 011, an auxiliary bearing 022 is provided in the front nose 012, and a main shaft 003 is supported rotatably by these bearings. On the other hand, a stationary scroll 004 and a revolving scroll 005 are arranged within the housing 013, and the stationary scroll 004 is fixed integrally in the housing 013 with a bolt 014. The stationary scroll 004 consists of an approximately disk-shaped end plate 041 and a spiral element 042. On the tip of the spiral element 042 there is mounted a tip seal 043 to give a better sealing, and a discharge port 044 is provided at about the central part of the end plate 041. Further, the revolving scroll 005 has an approximately disk-shaped end plate 051, a spiral element 052, and a boss 053 provided protruding in the end plate 051. A revolving bearing 023 for moving the revolving scroll 005 is installed within the boss 053, and a tip seal 054 is mounted on the tip of the spiral element 052 similar to the case of stationary scroll 004. The main shaft 003 has a balance weight 031 and a drive bush 032, and the drive bush 032 is supported rotatably by the revolving bearing 023 of the revolving scroll 005. In the front case 011 there is constructed a ball coupling which inhibits the rotation and permits the revolution of the revolving scroll 005 and receives a thrust force of the resolving scroll 005. Sealed small spaces 055, 056 and 057 are formed by engaging the spiral element 052 of the revolving scroll 005 with the spiral element 042 of the stationary scroll 004, with the phase of 180° between the spiral elements. Here, when the main shaft 003 is rotated by an engine or the like via a clutch (not shown), the revolving scroll 005 is driven via the drive bush 032. The revolving scroll 005 revolves around the stationary scroll 004 without rotation by means of the ball coupling 026. When the revolving scroll 005 revolves with a certain radius around the stationary scroll 004, the contact point of the spiral elements 042 and 052 moves from the outside toward inside of the spirals. As a result, the sealed small spaces 055, 056 and 057 formed by the engagement of the scrolls 004 and 005 are moved toward the center of the spirals 042 and 052 while reducing their volumes. A refrigerant gas sucked into an inlet chamber (not shown) from an external heat exchanger (not shown) or the like is sucked into the sealed small space 055 from a spiral outer end opening 058 of the spiral elements 042 and 052, compressed under the volume changes in the sealed small spaces 055, 056 and 057. Then, the gas moves successively toward the centers of the spiral elements 052 and 042, discharged to a discharge chamber 045 from the discharge port 044 provided on the end plate 041 of the stationary scroll 004, and is sent to the outside of the compressor main body 001 from the discharge chamber 045.

Figure 14:
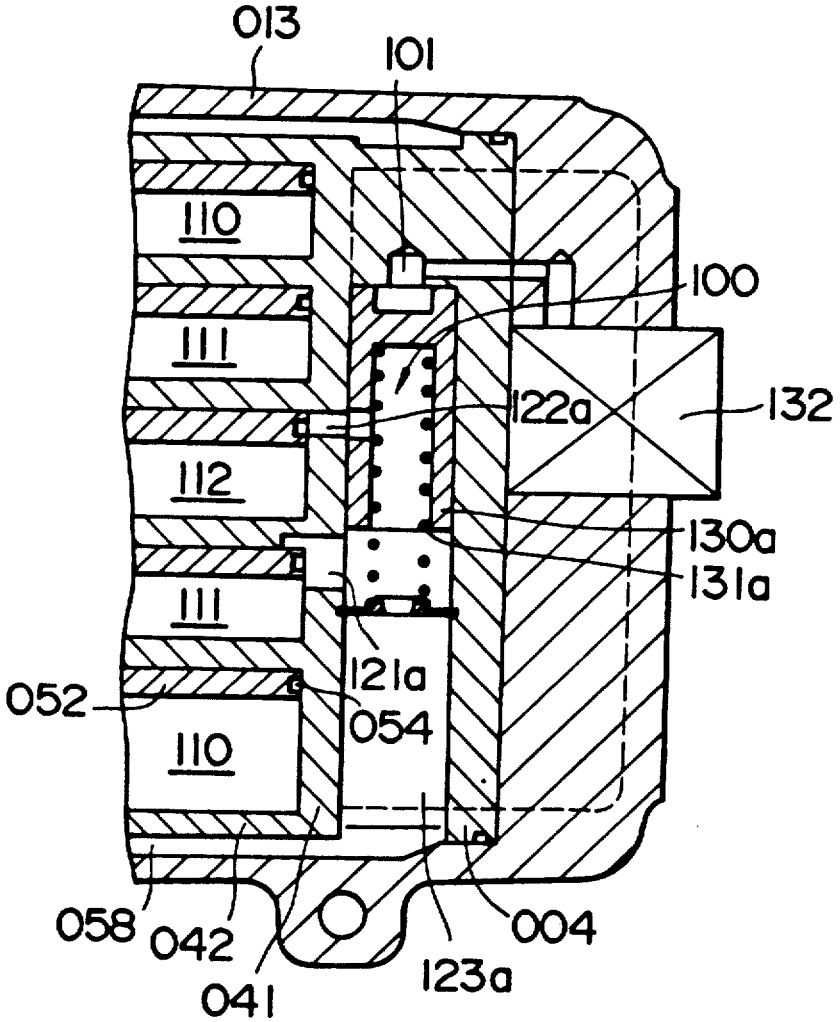
FIG. 14 (PRIOR ART)
FIG. 14 is a sectional view of the bypass passage of a prior art scroll compressor equipped with the capacity control mechanism.
Figure 15:
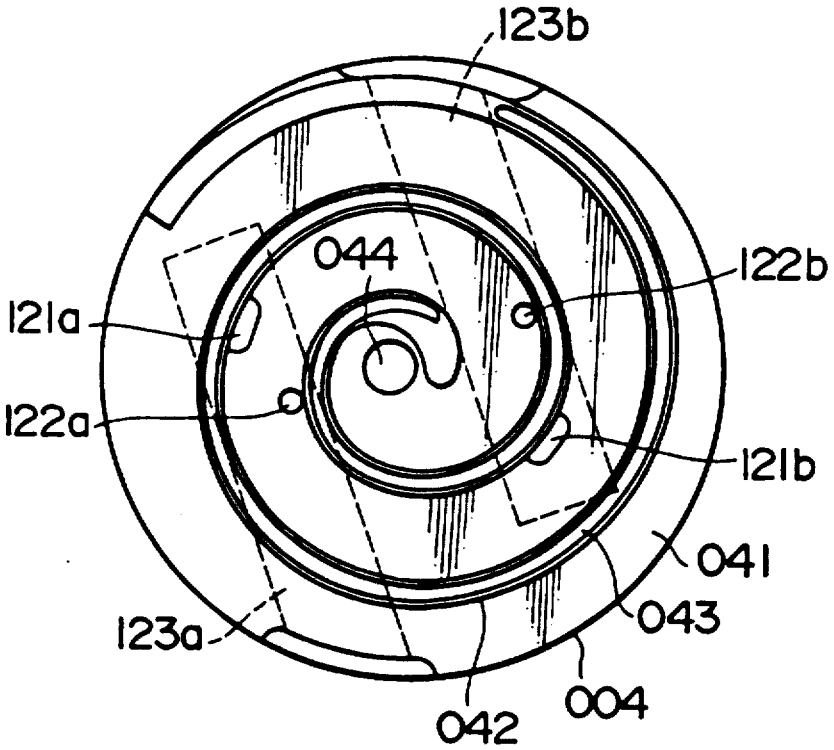
FIG. 15 (PRIOR ART)
FIG. 15 is a sectional view of the stationary scroll for the scroll compressor shown in FIG. 14.
Figure 16:
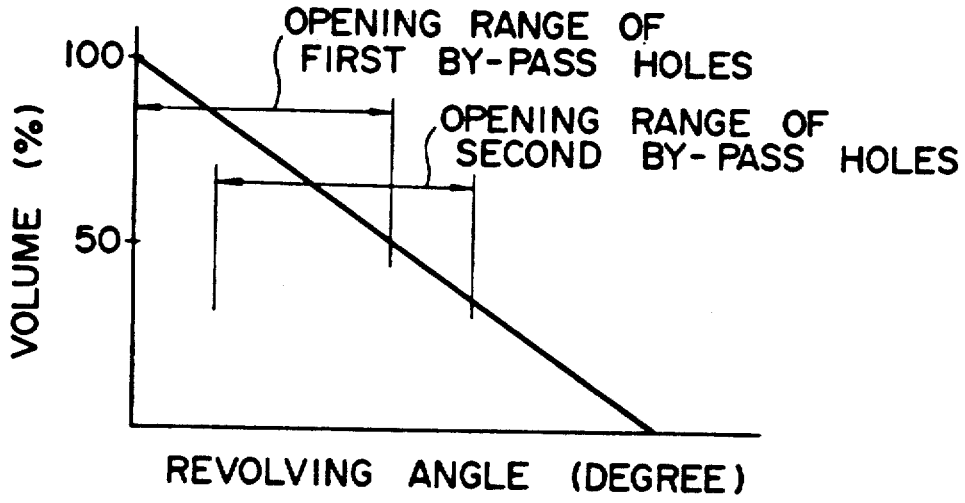
FIG. 16 (PRIOR ART)
FIG. 16 is a diagram showing the volume (compressed volume)—revolving angle relation.

When such a compressor is used as the compressor for an air conditioner on motor vehicle, the cooling capability of the air conditioner is raised in proportion to the rotational frequency of the vehicle engine because the main shaft 003 of the compressor is driven by the engine. For this reason, the cooling capability of the air conditioner becomes too large and the vehicle room is cooled excessively when the engine is running at high speed, and consequently, the air conditioning feeling is lowered due to the intermittent operation of the compressor. Moreover, it gives rise to a reduction in the traveling efficiency of the vehicle due to increase in the load of the compressor. In order to eliminate such an inconvenience there is sometimes provided a capacity control mechanism 100 (FIG. 14 is a vertical sectional diagram which is partially different from the vertical sectional diagram shown in FIG. 13) as shown in FIG. 14 and FIG. 15. First bypass holes 121*a* and 121*b* and second bypass holes 122*a* and 122*b* are provided to be opened to sealed small spaces 111 and 112, respectively, facing the end plate 041 of the stationary scroll 004. In addition, pistons are provided that open and close the pairs of the first and the second bypass holes 121*a*, 122*a* and 121*b* and 122*b*. Specifically, there is provided a piston 130*a* which internally equipped with a spring 131*a*, and which is constructed so as to receive a working pressure from a pressure control valve 132 on the other end 101 of the piston 103*a*. At the time of full load, the working pressure from the pressure control valve 132 is raised to apply a high pressure to the other end 101 of the piston 130*a* to let the piston 130*a* close the bypass holes 121*a* and 122*a*. At the same time, the bypass holes 121*b* and 122*b* are closed with another piston which is not shown in FIG. 14. On the other hand, at the time of capacity control, pressure from the pressure control valve 132 is lowered, the bypass holes 121*a* and 122*a* are opened by moving the piston 130*a* by means of the spring 131*a*, and the refrigerant gas is led from the sealed small spaces 111 and 112 to the bypass passage 123*a* via the bypass holes 121*a* and 122*a* to be led to the spiral outer end opening 058 or the inlet chamber (not shown), as may be understood by referring to FIG. 14. Now, the first bypass holes 121*a* and 121*b* and the second bypass holes 122*a* and 122*b* are ordinarily provided, as indicated in the volume-revolving angle relation shown in FIG. 16, at positions where the compressed volumes are in the vicinities of 50–60% and 25–40%, respectively, of the total volume of the compression space. Namely, the volume control used to be carried out so as to obtain a compressed volume in the vicinity of the position where it is 25–40% of the total volume due to the action of the first and the second bypass holes. It is to be noted that the curve shown in FIG. 16 corresponds to the case where the top clearance volume that is generated from the revolving angle at which the two scrolls start to be separated at the central parts is neglected.

As described in the above, in the case of the scroll compressor, the range of capacity control is not wide enough, similar to the case of the rotary compressor, so that there has been a problem that the air conditioning feeling is spoiled due to intermittent operation of the compressor.

In what follows an embodiment of the present invention as applied to the scroll compressor will be described.

Figure 17:
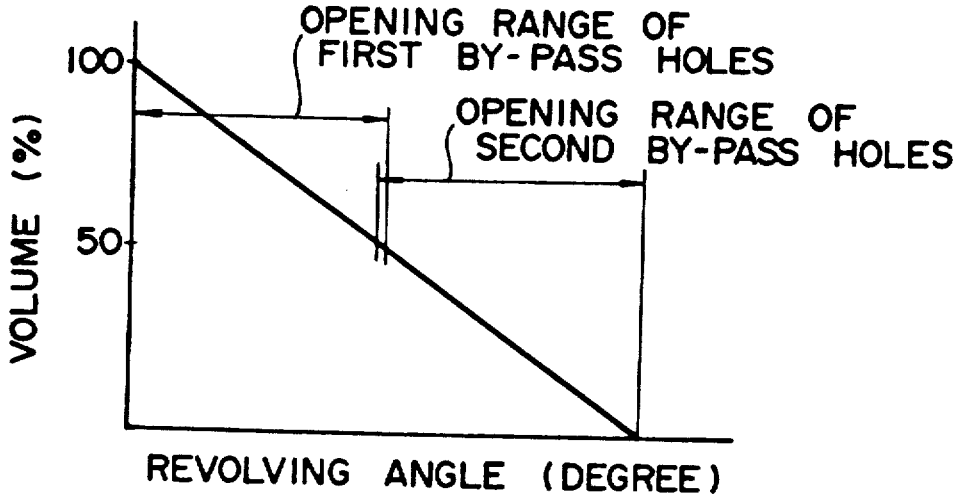
FIG. 17 is the volume-revolving angle relation diagram of a fourth embodiment of the present invention as applied to the scroll compressor.
Figure 18:
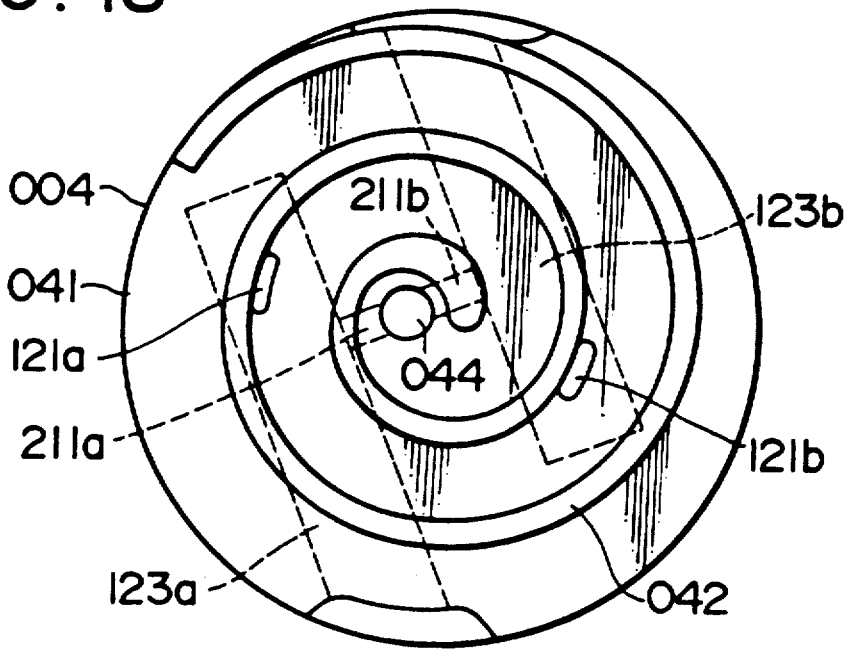
FIG. 18 is a sectional diagram of a stationary scroll.

FIG. 17 is a diagram showing the volume-revoling angle relation for the fourth embodiment of the present invention, that is, a diagram showing the relation between the compressed volume of the compression space and the revolving angle of the revolving scroll, and FIG. 18 is a sectional diagram of the stationary scroll of the above embodiment. In the drawings, 004 is a stationary scroll which is composed of an end plate 041 and a spiral element 042 similar to the conventional device, and first bypass holes 121*a* and 121*b* are provided analogous to the conventional device. It is desirable to determine the range of opening of the first bypass holes 121*a* and 121*b* so as to cover, including the case of volume of 100%, the lower volume percent region in the diagram for the volume-revolving angle relation. Second bypass holes 211*a* and 211*b* are provided in such a way that one end of the respective holes is opened to a discharge port 044, and the other end of the respective holes is provided on an end plate 041 of the stationary scroll 004 so as to be opened to a bypass passage 123*a* or 123*b* that is opened and closed by a piston (not shown). Components other than those mentioned above, namely, the piston, spring, bypass passages 123*a* and 123*b*, and pressure control valve are installed in the same way as in the conventional capacity control mechanism.

By opening bypass holes to the discharge port as in the above, the range of the revolving angle of the revolving scroll for which the bypass holes are opened, can be made to cover the range of 100-0% of the compressed volume, so that it becomes possible to increase markedly the capacity control range of the conventional capacity control mechanism. That is, by increasing the capacity control range the cooling capability at the time of capacity control, even during the between season, winter season and the like, is decreased substantially, so that there will be no cooling capability generated that is more than what is necessary. As a result, the compressor can be operated continuously and degradation of the air conditioning feeling due to intermittent operation of the compressor can be avoided. It should be noted that the situation is analogous at the time of fast operation of the compressor.

Fifth Embodiment

Figure 19:
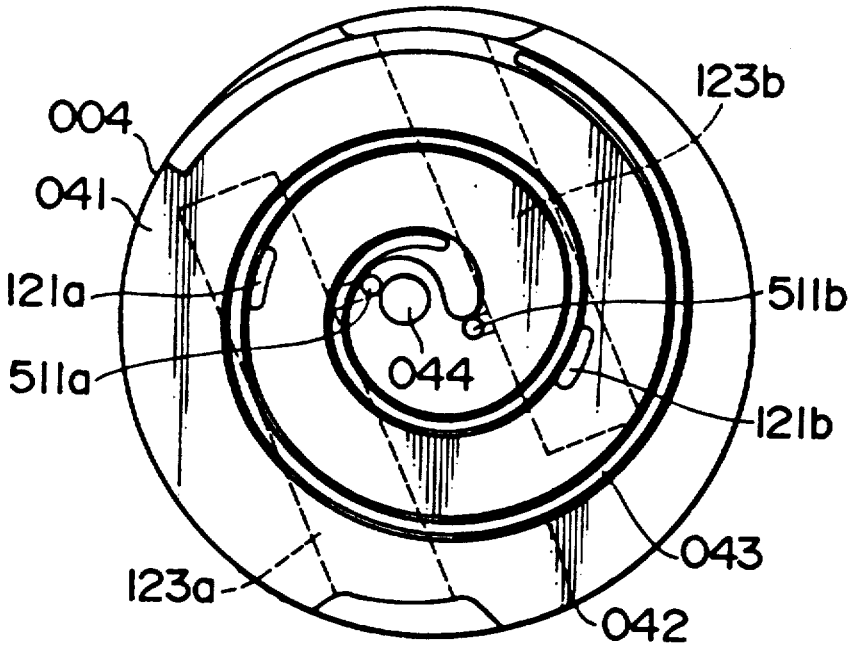
FIG. 19 is a sectional diagram of the stationary scroll of a fifth embodiment of the present invention.

In the fourth embodiment, bypass holes at the position of compress value 0% are opened at the discharge port. However, instead of these bypass holes 211*a* and 211*b*, in the fifth embodiment of the present invention shown in FIG. 19 and FIG. 20, second bypass holes 511*a* and 511*b* are provided in the regions that are on the inner side of the spiral element than the marginal points that are determined by the marginal angle for defining a due involute curve of the spiral element. In this case, capacity control in the range of 100–0% becomes also possible similar to the fourth embodiment.

Figure 20:
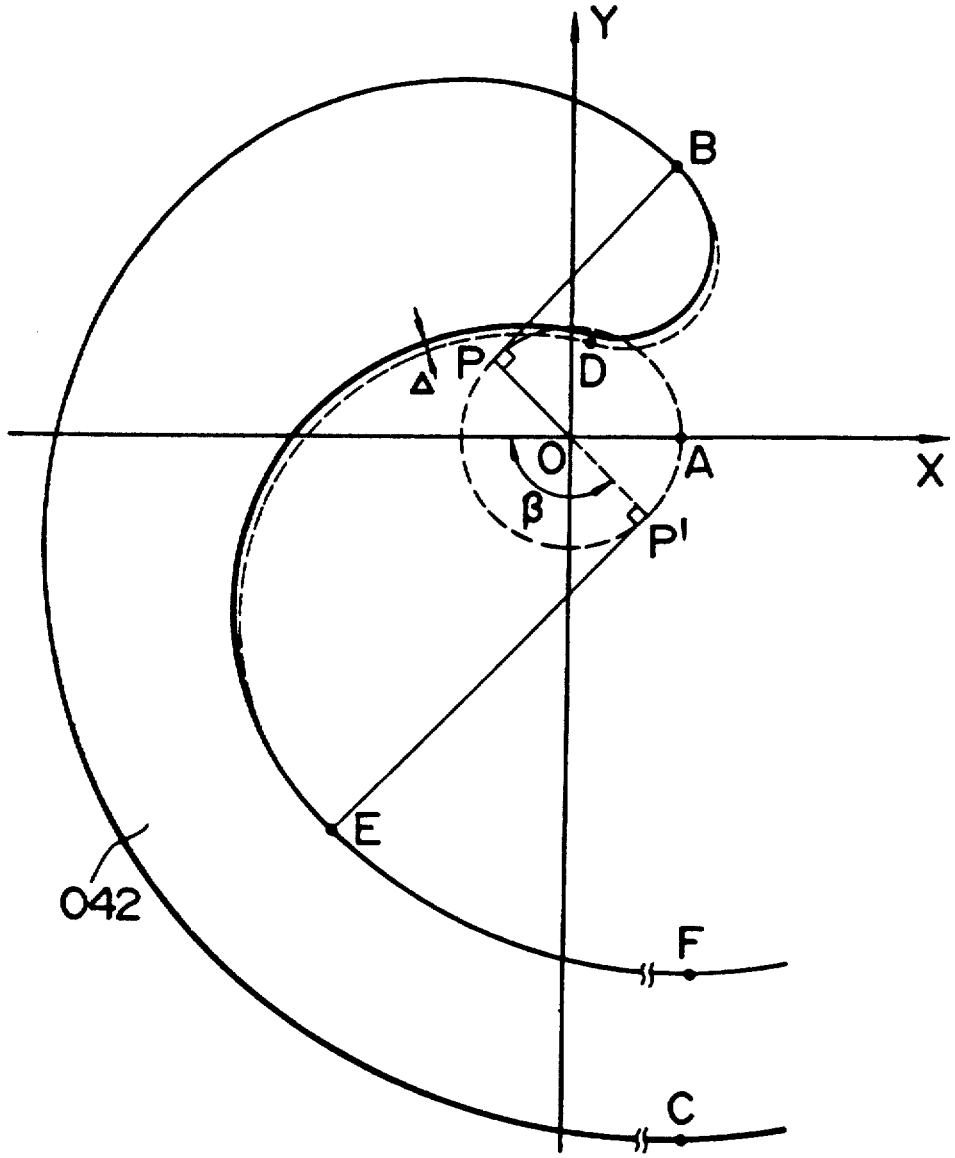
FIG. 20 is an enlarged diagram of the inner portion of the spiral element.

FIG. 20 is an enlarged diagram of the inner end portion of the spiral element, and the way of determining its profile is shown, for example, in Japanese Patent Application, No. 62-17074. The points B and E in the drawing represent the marginal points determined by the angle $\beta$ of the marginal angle for defining a due involute curve. In the region on the inner side of the points B and E, there are provided a small clearance $\Delta$ for avoiding abnormal collision with the revolving scroll. Because of this, engagement between both scrolls begins to be separated in the region on the inner side of the points B and E. If the top clearance volume that is generated by the separation of both scrolls in the inner central portion is neglected in the diagram for the volume-revolving angle relation, the compressed volume at the points B and E will become 0%.

The position on the stationary scroll at which the ratio of the compress volume to the volume of the compression space is about several percents or smaller is in the range of $3\times360^\circ\times(0.08 \text{ to } 0.05)=86^\circ$ to $54^\circ$ since the number of spiral elements of a compressor of ordinary use is about three. That is, it is a position less than about 90° to the outside of the points B and E along the spiral.

Sixth Embodiment

Figure 21:
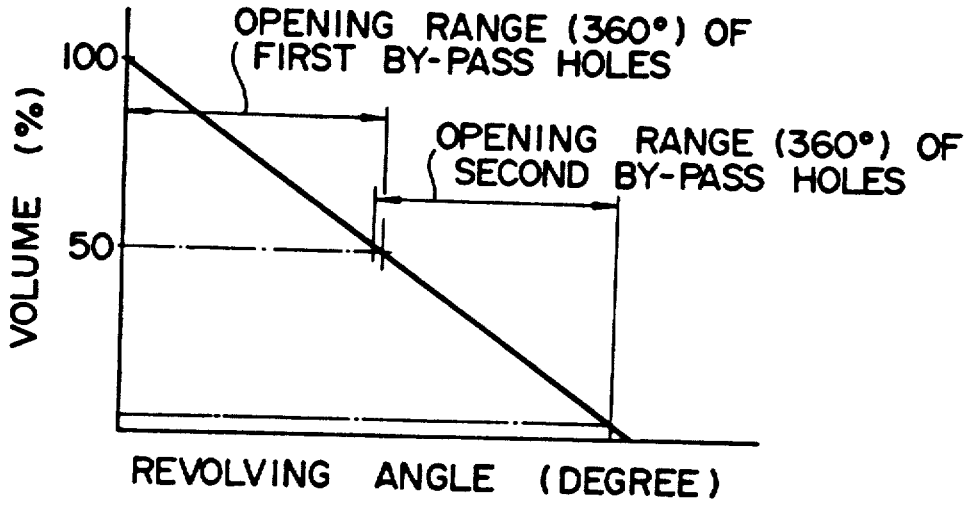
FIG. 21 is the volume-revolving angle diagram for a sixth embodiment of the present invention.
Figure 22:
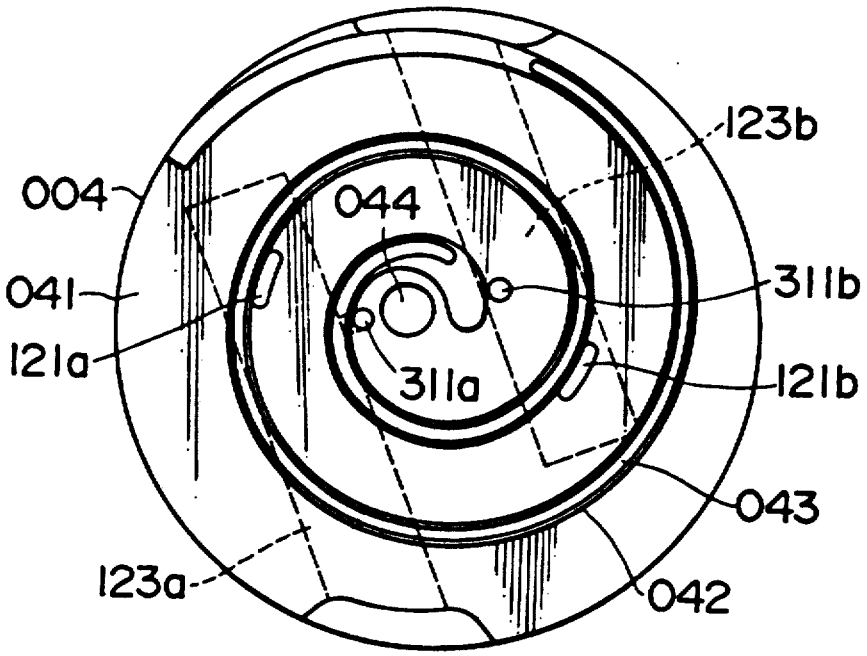
FIG. 22 is a sectional diagram of the stationary scroll of the above embodiment.

FIG. 21 and FIG. 22 representing the sixth embodiment shows an example in which the capacity control is arranged to cover the compressed volume in the range of 100 to several percents. FIG. 22 shows a sectional diagram of the stationary scroll of the present embodiment. Reference numerals 311*a* and 311*b* are bypass holes at the position of volume of about several percents provided in place of 511*a* and 511*b* of the fifth embodiment, and the remaining constitution of the embodiment is similar to the case of the fifth embodiment. The effect realizable is the same as the fifth embodiment.

Seventh Embodiment

Figure 23:
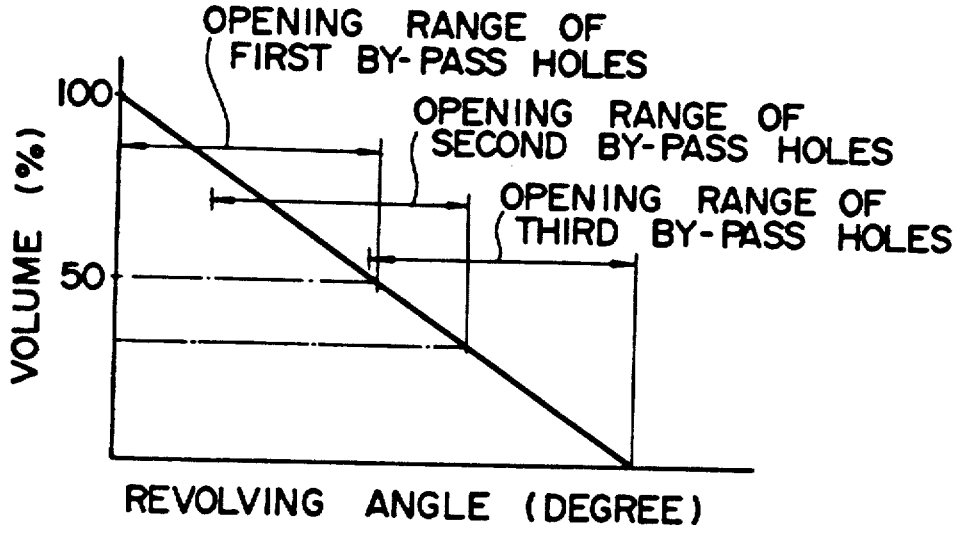
FIG. 23 is the volume-revolving angle diagram for a seventh embodiment of the present invention.
Figure 24:
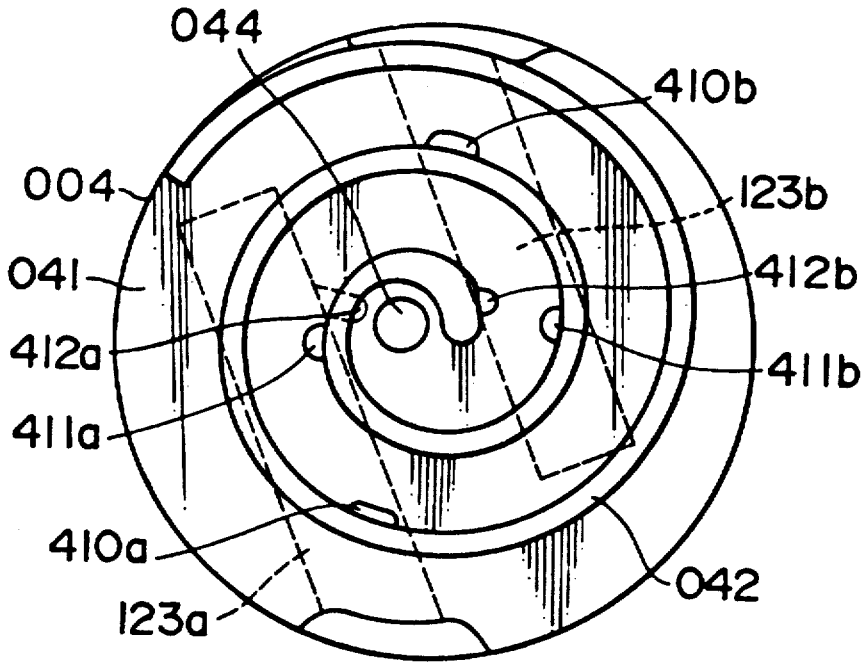
FIG. 24 is a sectional diagram the stationary scroll of the above embodiment.

FIG. 23 is a diagram showing the volume-revolving angle relation in accordance with the seventh embodiment of the present invention and FIG. 24 is a sectional diagram of the stationary scroll of the present embodiment. This embodiment is provided with three pairs of bypass holes. Reference numerals 410*a* and 410*b* are first bypass holes, 411*a* and 411*b* are second bypass holes provided at the position of volume of about 30%, and 412*a* and 412*b* are third bypass holes. The remaining portion is the same as the sixth embodiment. The embodiment characterized in that it can realize an effect of finer capacity control.

Summary of the Embodiments

The embodiments described in the foregoing may be summarized as in the following.

The first embodiment is an example in which a bypass passage is provided from the discharge port to the inlet space, a capacity control valve (pressure control valve) is installed in a part of the bypass passage, and the discharge quantity of the compressor is controlled in the range of 0–100% by means of the opening of the capacity control valve.

The second embodiment is an example in which a bypass hole is provided at the position of capacity of about 50%, in series to the bypass hole of the first embodiment, and the discharge quantity of the compressor is controlled to be in the range of 0–100% by regulating the opening of the capacity control valve.

The third embodiment is an example in which a bypass hole is provided at the position of capacity of about 30%, in series to those of the second embodiment, and the discharge quantity of the compressor is controlled to be in the range of 0–100% by regulating the opening of the capacity control valve.

The fourth embodiment and the fifth embodiment are examples in which, on the assumption that the volume at the time of intake shutoff is 100% and that at the time of discharge completion is 0% in the diagram showing the volume-revolving angle relation of the compressor, bypass holes are provided at the discharge port or within marginal points determined by a marginal angle for defining a due involute curve, bypass passages are provided leading from the bypass holes to the inlet space, a capacity control valve is installed in a portion of the bypass passages, and the discharge quantity of the compressor is controlled in the range of 0–100% by regulating the opening of the capacity control valve.

The sixth embodiment is an example in which the position of the bypass hole for volume of 0% is provided at a position for volume of several percents which is somewhat on the outside of that of 0%, and the discharge quantity of the compressor is controlled in the range of several to 100% by regulating the opening of the capacity control valve.

The seventh embodiment is an example in which a bypass hole at the volume position of about 30% in series to those of the sixth embodiment, and the discharge quantity is controlled in the range of several to 100% by regulating the opening of the capacity control valve.

We claim:

1. In a scroll type compressor having a stationary scroll member and a revolving scroll member, each of said scroll members having spiral elements which engage with one another to form a compression space having a volume which is reduced upon movement of said revolving scroll member around said stationary scroll member, said stationary scroll member having an end plate formed with a discharge port in communication with said compression space whereby fluid drawn into said compression space under suction from an inlet space of said compressor is compressed by a reduction in volume of said compression space and discharged through said discharge port, said end plate having a bypass hole in communication with said compression space for bypassing fluid under compression to said inlet space, and the opening of said bypass hole being adjusted by a piston valve to control the discharge quantity of said compressor, wherein the improvement comprises: a plurality of additional bypass holes for bypassing fluid under compression to said inlet space when said holes are open, said additional bypass holes being respectively at positions along the spiral element of said stationary scroll member for which the compression volumes in said compression space as related to the revolving angle of said revolving scroll are at predetermined percentages, one of said additional bypass holes being positioned substantially at the innermost point of said spiral element in the vicinity of said discharge port, and piston valve means operable to adjust the opening of said bypass holes thereby to control the capacity of said compressor by an amount within the range of 100% to 0% of discharge quantity and permit continuous operation of said compressor over load fluctuations.

2. The scroll type compressor of claim 1, wherein said discharge port in at the center of said end plate, and said one of said additional bypass holes is in communication with said discharge port.

3. The scroll type compressor of claim 2, wherein said one of said additional bypass holes is positioned at said discharge port.

4. The scroll type compressor of claim 1, wherein one of said additional bypass holes is positioned along the spiral element of said stationary scroll at a position less than about 90° inwardly of a marginal point defining an involute curve of said spiral element.

5. The scroll type compressor of claim 1, wherein said additional bypass holes comprise a pair of such holes respectively positioned along the spiral element of said stationary scroll at positions less than about 90° inwardly of marginal points defining an involute curve of said spiral element, said pair of such holes being respectively disposed along the inner curve of said spiral element.

* * * * *